United States Patent [19]

Jackson et al.

[11] Patent Number: 4,919,447

[45] Date of Patent: Apr. 24, 1990

[54] CROSS COUNTRY SKI

[75] Inventors: James E. Jackson; Denis Wardlow, both of Quebec, Canada

[73] Assignee: Allsop, Inc., Bellingham, Wash.

[21] Appl. No.: 169,623

[22] Filed: Mar. 18, 1988

[51] Int. Cl.[5] ..... A63C 7/06

[52] U.S. Cl. ..... 280/604; 280/609

[58] Field of Search ..... 280/601, 604, 608, 609, 280/610, 614, 615

[56] References Cited

U.S. PATENT DOCUMENTS

| | | | |
|---|---|---|---|
| 2,752,103 | 5/1979 | Auer | 280/604 |
| 2,914,335 | 11/1959 | Rivard | 280/604 |
| 3,874,315 | 4/1975 | Wright | 280/604 |
| 4,027,895 | 6/1977 | Larsson | 280/604 |
| 4,118,050 | 10/1978 | Schnurrenberger | 280/604 |
| 4,223,909 | 9/1980 | Danner et al. | 280/604 |
| 4,280,715 | 7/1981 | Freelander et al. | 280/607 |
| 4,320,908 | 3/1982 | Ellingsen et al. | 280/604 |
| 4,323,265 | 4/1982 | Benner | 280/604 |
| 4,353,573 | 10/1982 | Morgan | 280/606 |
| 4,406,478 | 9/1983 | Stoufer | 280/604 |

FOREIGN PATENT DOCUMENTS

| | | |
|---|---|---|
| 0015447 | 9/1980 | European Pat. Off. . |
| 1954075 | 5/1971 | Fed. Rep. of Germany . |
| 2724711 | 9/1978 | Fed. Rep. of Germany . |
| 179481 | 9/1935 | Switzerland . |

*Primary Examiner*—David M. Mitchell
*Assistant Examiner*—Richard Camby
*Attorney, Agent, or Firm*—Hughes & Multer

[57] ABSTRACT

A cross country ski having a bottom running surface with a plurality of grooves formed thereon. Each groove has a central portion extending transversely to the length of the ski and two lateral portions slanting rearwardly and outwardly from the forward portion. Each groove has a surface slanting toward a flat portion coincident with the running surface, in a manner that at any transverse location on the bottom of the ski a portion of the bottom surface is in contact with the surface of the snow.

27 Claims, 2 Drawing Sheets

12
22
20
18
10
16
14
24

12
30
22
32
44
18
10
20
28
26
16
20
24
14

18
28
26
16
a
b
c
d
e

CROSS COUNTRY SKI

BACKGROUND OF THE INVENTION

1. Field of the Invention

The present invention relates to a cross country ski, and more particularly to an improved bottom running surface for a cross country ski.

2. Background Art

In a cross country ski, it is desirable that the bottom surface be formed with recesses which inhibit rearward movement of the ski, with these recesses being formed in a manner to provide relatively little frictional resistance or other resistance to forward motion of the ski over the snow's surface. Thus, when the skier is traveling uphill, the ski is able to grip the snow to prevent rearward sliding. On the other hand, when the ski is gliding, for example, on a downhill run, the small frictional resistance is desirable.

Another factor is that it is desirable to have the ski glide in a forward direction over the snow's surface in a manner to minimize any noise that may be created. It is common for a cross country ski to form something of a buzzing sound as the ski slides over the snow's surface.

There are various groove configurations for skis. One configuration which has appeared in the prior art is to provide the ski with a plurality of semicircular or scalloped shaped recesses, with the concave face of the curved recess facing in a rearward direction, and with the bottom surface of the recess slanting gradually downwardly toward the bottom of the surface of the ski in a rearward direction.

Accordingly it is an object of the present invention to provide a cross country ski having an improved bottom surface configuration which provides adequate resistance to rearward sliding of the ski over the snow's surface, while minimizing frictional resistance to a forward gliding movement of the ski over the snow, and also to alleviate or reduce unwanted noise that can result from the ski gliding over the snow's surface.

SUMMARY OF THE INVENTION

The cross country ski of the present invention has a front end, a rear end, two side surfaces, a bottom running surface at a lower contact plane, a forward to rear longitudinal axis and a transverse axis.

The ski is characterized in that the bottom surface is formed with a plurality of grooves extending generally transversely across the bottom surface of the ski. Each groove comprises a middle groove portion and two side groove portions which extend from the middle groove portion laterally and outwardly toward said side surfaces with a moderate rearward slant.

Each of these grooves has a forward groove surface portion having a relatively steep vertical alignment component to form a relatively sharp lower forward edge at the bottom contact plane, and also a main surface portion extending from an upper edge portion of the forward groove portion rearwardly at a moderate downward slope to the contact plane occupied by the bottom surface. The grooves are spaced longitudinally from one another so that there are intermediate bottom surface portions lying in said contact plane and positioned between adjacent pairs of grooves.

In the preferred configuration, the middle groove portion extends transversely at substantially a right angle to the longitudinal axis, and desirably has a lengthwise dimension at least about a quarter of a width dimension of the skis.

Also, in the preferred form, the bottom ski surface is formed with a longitudinally extending center groove.

Further, in the preferred form, grooves positioned at a middle portion of the ski are spaced more closely to one another than the grooves which are positioned at more forward and rearward locations on the ski.

Desirably, the slant of the side groove portions, relative to a transverse horizontal axis is between about one-sixth to one-half of a right angle, and more desirably is between about one-quarter to one-third of a right angle. In the preferred configuration, this angle is about 25 degrees.

Also, in the preferred form, the forward groove surface portion makes an angle from the vertical between about zero degrees one-half of a right angle. In the preferred form, this angle is between about one-fifth of a right angle to one-third of a right angle. Also, in the preferred form, a maximum depth dimension of each groove is between about one one-hundredth of an inch to one-twentieth of an inch, and preferably between about 2 hundredths of an inch to 3 hundredths of an inch. The preferred depth dimension is about 2.5 hundredths of an inch.

DESCRIPTION OF THE PREFERRED EMBODIMENT

Figure 1:
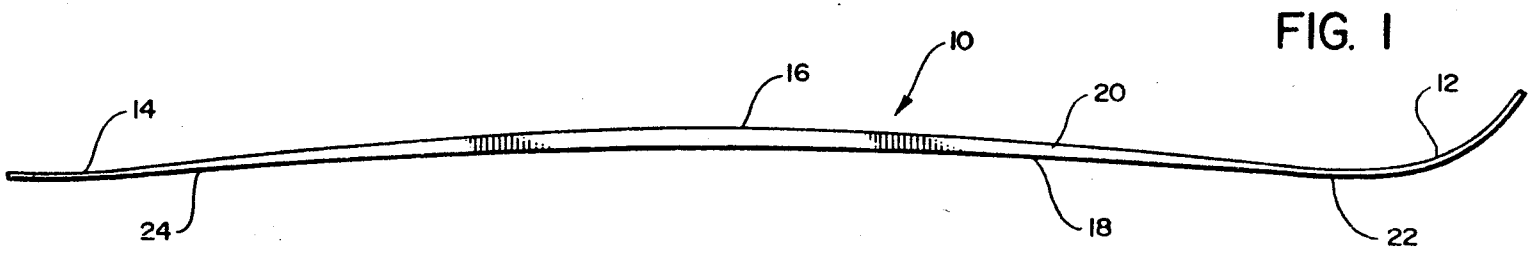
FIG. 1 is a side elevational view of the ski of the present invention.
Figure 2:
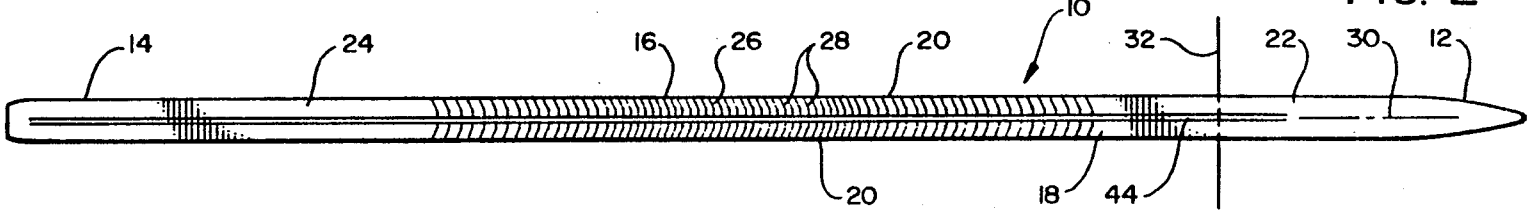
FIG. 2 is a bottom plan view thereof.

The ski 10 has a forward end 12, a rear end 14, a main middle portion 16, a bottom surface 18, and two side surfaces 20. For purposes of description, the ski 10 can be considered as having a forward to rear extending longitudinal axis 30, and a transverse axis 32. (See FIG. 2.) The forward and rear bottom surface portions 22 and 24, respectively, are made generally flat. The bottom middle surface portion 26 is made with a plurality of transversely extending grooves 28.

Figure 4:
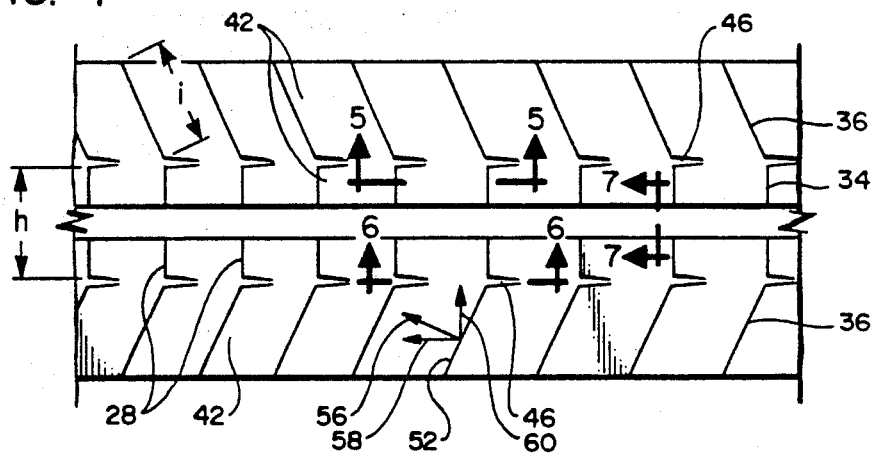
FIG. 4 is a further view of a bottom portion of a middle section of said ski, drawing to a yet further enlarged scale.
Figure 5:
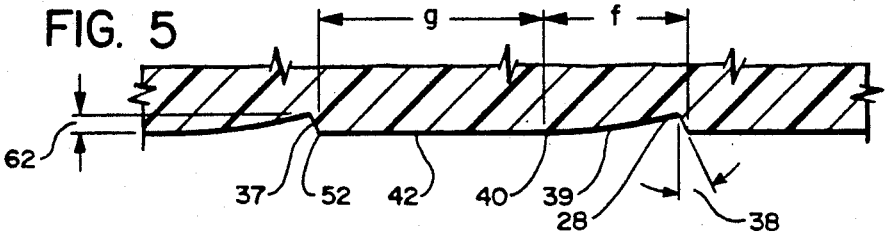
FIG. 5 is a sectional view taken along line 5—5 of FIG. 4.
Figure 6:
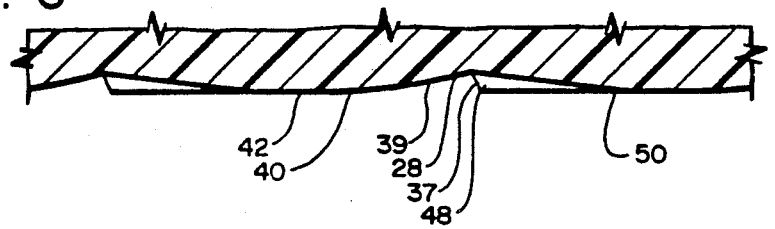
FIG. 6 is a view taken along line 6—6 of FIG. 4.

With reference to FIG. 4, it can be seen that each groove 28 comprises a middle portion 34 and two side portions 36. Further, as can be seen in FIGS. 5 and 6, each groove 28 has, in transverse section, a forward surface portion 37 which has a relatively steep slant, relative to the vertical. This slant, indicated at 38 in FIG. 5, is desirably between about zero degrees to one-half of a right angle, and more desirably between about one-fifth to one-third of a right angle. In general, it is between about 20 degrees to 30 degrees.

Each groove also has a main downwardly facing surface portion 39 which has a very moderate downward slope to blend in a continuous curve at 40 to an intermediate bottom surface portion 42. Each bottom surface portion 42 lies in a contact plane which the bottom surface 18 occupies. The outer groove surface portions 36 have a transverse sectional configuration substantially the same at the middle groove portion 34.

Figure 7:
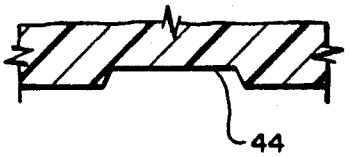
FIG. 7 is a view taken along line 7—7 of FIG. 4.

The bottom surface 18 is formed with a longitudinally extending center groove 44 (see FIG. 7). Further, at the juncture location of the outer groove portions 36 and the inner groove portions 34, there are recessed longitudinally extending juncture portions 46 which have at the rear end portion 48 (see FIG. 6) a depth approximately the same as the forward portion of each groove 34, and with the depth diminishing in a forward direction to the forward end location 50.

In operation, when the skier is traveling uphill, the grooves 28 engage the snow's surface in a manner to deter to a large extent rearward sliding of the ski 10. On the other hand, when the ski is gliding (e.g., in a downhill guide), the action of the bottom surface 18 on the snow is such that a relatively smaller amount of frictional resistance is created. It will be noted that the grooves 28 are arranged, relative to one another, so that the intermediate flat bottom portions 42 that lie in the contact plane have, relative to a line drawn transversely of the bottom ski surface, always a portion thereof in contact with the snow. Further, the groove side portions 36 are slanted in a manner that the engagement of the lower front edge 52 of the side groove portions 36 can be considered as having a main diagonal component 56 perpendicular to the edge 52, a rearwardly facing component 58 and a lateral component 60. It can be theorized that this slanting engagement has the effect, relative to the contact of the snow's surface and possibly relative to a small air space immediately rearwardly of the forward groove surface 37 of diminishing the dynamic effect of the motion of the ski surface 18 relative to the snow's surface to alleviate the effect of very small impacts and transmit energy of such impacts in a transverse direction toward the longitudinal centerline of the ski.

In any event, regardless of the correctness of accuracy of the above hypothesis, it has been found that a ski made with the configuration as indicated above, is capable of gripping the snow's surface in a manner to adequately resist rearward sliding, while minimizing frictional resistance and/or other resistance to forward gliding. Also, it has been found that relative to prior art ski configuration now in use, the ski of the present invention creates relatively less noise when gliding.

Desirably, the maximum depth dimension 62 of each groove 28 (see FIG. 5) is between about one-hundredth of an inch to one-twentieth of an inch, and preferably between about two-hundredths of an inch to three-hundredths of an inch. The preferred dimension is about 2.5 hundredths of an inch.

The slant of the side groove portions 36 is desirably between about one-sixth to one-half of a right angle, and more desirably between about one-quarter to one-third of a right angle. In the preferred configuration, this angle is about 25 degrees.

Figure 3:
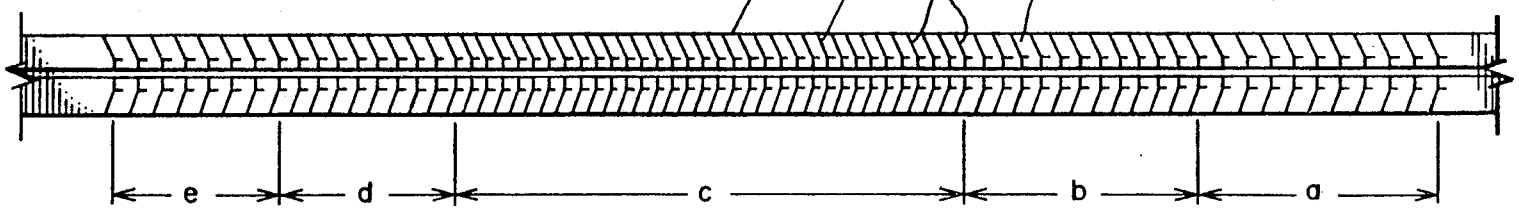
FIG. 3 is a bottom plan view of the middle section of the ski in FIG. 2, drawn to an enlarged scale.

The spacing of the various grooves 28 in the preferred configuration is shown in FIG. 3. At the forward section "a" there are 10 equally spaced grooves having a spacing of about 0.6 inch. A second section "b" has 12 equally spaced grooves 28 with a spacing of 0.5 inch, for a total lengthwise dimension of about 6 inches. The middle section "c" has a total lengthwise dimension of 13.2 inches, with 33 grooves being spaced at about 0.4 inch. The next section "d" has a total length dimension of about 4.5 inches, with 9 grooves being spaced at 0.5 inch. Finally, the rear section has a total length dimension of 4.2 inches, with 7 equally spaced grooves 28 at a spacing of 0.6 inch each.

At the middle section of the ski where the grooves are placed most closely together, the lengthwise dimension of each groove "f" (see FIG. 5) is moderately less than half the lengthwise dimension "g" of the adjacent flat surface portion 42 which lies in the contact plane of the bottom surface. Desirably, the lengthwise dimension "f" would be between about one-quarter to one half of the lengthwise dimension "g" and preferably about one-third of the dimension. The width dimension of the ski in the preferred embodiment is about two inches. The total lengthwise dimension "h" of the forward groove portion 34 is approximately equal to the lengthwise dimension "i" of each of the side groove portions 36, and broadly between about two times to one-half times the dimension of each of the side groove portions 36.

It is apparent that various modifications can be made without departing from the teaching of the present invention.

What is claimed is:

1. A cross country ski having a front end, a rear end, two side surfaces, a bottom running surface lying generally in a bottom contact plane, a forward to rear longitudinal axis, a transverse axis, and a vertical axis, said ski being characterized in that said bottom surface is formed with a plurality of grooves extending generally transversely across the bottom surface, each groove comprising:

(a) a middle groove portion extending substantially parallel to the transverse axis;

(b) two side groove portions extending from said middle portion laterally and outwardly to said side surfaces, with a moderate rearward slant at a substantially constant fixed rearward angle; and (c) each of said grooves having a forward groove surface portion having a relatively steep vertical alignment component to form a relatively sharp lower forward edge at said bottom surface, and a main surface portion extending from an upper edge portion of said forward groove portion rearwardly at a moderate downward slant to said contact plane.

2. The ski as recited in claim 1, wherein the side groove portions form a groove slant angle with said transverse axis of between about one-sixth to one-half of a right angle.

3. The ski as recited in claim 2, wherein said groove slant angle is between about one-quarter to one-third of a right angle.

4. The ski as recited in claim 2, wherein said groove slant angle is about 25 degrees.

5. The ski as recited in claim 1, wherein said groove surface portion makes a vertical angle with said vertical axis of less than one-half of a right angle.

6. The ski as recited in claim 5, wherein said vertical angle is between about zero degrees to one-third of a right angle.

7. The ski as recited in claim 5, wherein said vertical angle is between about one-fifth to one-third of a right angle.

8. The ski as recited in claim 1, wherein each of said grooves has a maximum depth dimension of between about one-hundredth of an inch to one twentieth of an inch.

9. The ski as recited in claim 8, wherein said maximum depth dimension is between about two-hundredths of an inch to three-hundredths of an inch.

10. The ski as recited in claim 9, wherein said maximum depth dimension is about 2.5 hundredths of an inch.

11. The ski as recited in claim 1, wherein said bottom surface of the ski has an intermediate bottom surface section between front and rear bottom surface sections of the ski, and said intermediate bottom surface section has bottom surface segments positioned between adjacent pairs of grooves.

12. The ski as recited in claim 11, wherein the grooves at said intermediate bottom surface section each has a lengthwise dimension between about one-quarter to one-half of a lengthwise dimension of said bottom surface segments.

13. The ski as recited in claim 12, wherein the lengthwise dimension is between about one-third of the lengthwise dimension of said bottom surface segments.

14. A cross country ski having a front end, a rear end, two side surfaces, a bottom running surface lying generally in a bottom contact plane, a forward to rear longitudinal axis, a transverse axis, and a vertical axis, and ski comprising:

(a) a plurality of grooves formed in said bottom surface and extending generally transversely across the bottom surface, each groove comprising:
  (i) a middle groove portion having a substantial alignment component perpendicular to said longitudinal axis;
  (ii) two side groove portions extending from said middle portion laterally and outwardly to said side surfaces, with a moderate rearward slant in a manner that said side groove portions extend to side edges of said ski; and
  (iii) each of said grooves having a forward groove surface portion having a relatively steep vertical alignment component to form a relatively sharp lower forward edge at said bottom surface, and a main surface portion extending from an upper edge portion of said forward groove portion rearwardly at a moderate downward slant to said contact plane.

(b) a plurality of substantially flat intermediate surface portions extending across said bottom surface at said contact plane and positioned alternately with said grooves; and (c) outer end portions of the forward groove surface portions of each side groove portion terminating at a transverse location rearwardly of a forward middle portion of an adjacent rearwardly positioned intermediate surface portion in a manner that a line drawn transversely across the forward middle portion of the intermediate portion also extends over outer end portions a next forward one of said intermediate portions.

15. The ski as recited in claim 14, wherein the side groove portions form a groove slant angle with said transverse axis of between about one sixth to one-half of a right angle.

16. The ski as recited in claim 15, wherein said groove slant angle is between about one-quarter to one-third of a right angle.

17. The ski as recited in claim 14, wherein each of said grooves has a maximum depth dimension of between about one-hundredth of an inch to one-twentieth of an inch.

18. The ski as recited in claim 17, wherein said maximum depth dimension is between about two-hundredths of an inch to three-hundredths of an inch.

19. The ski as recited in claim 14, wherein the grooves each have a lengthwise dimension parallel to said longitudinal axis between about one-quarter to one-half of a lengthwise dimension of each of said intermediate surface portions.

20. The ski as recited in claim 19, wherein the lengthwise dimension is between about one-third of the lengthwise dimension of said intermediate portions.

21. A cross country ski having a front end, a rear end, two side surfaces, a bottom running surface lying generally in a bottom contact plane, a forward to rear longitudinal axis, a transverse axis, and a vertical axis, said ski comprising:

(a) a plurality of grooves formed in said bottom surface extending generally transversely across the bottom surface, each groove comprising:
  (i) a middle groove portion;
  (ii) two side groove portions extending from said middle portion laterally and outwardly towards said side surfaces, with a moderate rearward slant in a manner that said side groove portions extend to said side edges of said ski; and
  (iii) each of said grooves having a forward groove surface portion having a relatively steep vertical alignment component to form a relatively sharp lower forward edge at said bottom surface, and a main surface portion extending from an upper edge portion of said forward groove portion rearwardly at a moderate downward slant to said contact plane.

(b) a plurality of substantially flat intermediate portions extending across said bottom surface at said contact plane and positioned alternately with said grooves; and (c) said intermediate surface portions having a total surface area greater than a surface area of said grooves, with a lengthwise dimension of each of said intermediate portions parallel to said longitudinal axis being greater than a lengthwise dimension of each of said grooves.

22. The ski as recited in claim 21, wherein the side groove portions form a groove slant angle with said transverse axis of between about one-sixth to one-half of a right angle.

23. The ski as recited in claim 22, wherein said groove slant angle is between about one-quarter to one-third of a right angle.

24. The ski as recited in claim 21, wherein each of said grooves has a maximum depth dimension of between about one-hundredth of an inch to one-twentieth of an inch.

25. The ski as recited in claim 24, wherein said maximum depth dimension is between about two-hundredths of an inch to three-hundredths of an inch.

26. The ski as recited in claim 25, wherein the grooves each has a lengthwise dimension between about one-quarter to one-half of a lengthwise dimension of each of said intermediate portions.

27. The ski as recited in claim 26, wherein the lengthwise dimension if between about one-third of the lengthwise dimension of said intermediate portions.

* * * * *